US011629733B2

(12) United States Patent
Eslinger et al.

(10) Patent No.: US 11,629,733 B2
(45) Date of Patent: Apr. 18, 2023

(54) ANTI-SWIRL RIBS IN ELECTRIC SUBMERSIBLE PUMP BALANCE RING CAVITY

(71) Applicant: Schlumberger Technology Corporation, Sugar Land, TX (US)

(72) Inventors: David Eslinger, Houston, TX (US); Kean Wee Cheah, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 43 days.

(21) Appl. No.: 17/448,568

(22) Filed: Sep. 23, 2021

(65) Prior Publication Data

US 2022/0090609 A1 Mar. 24, 2022

Related U.S. Application Data

(60) Provisional application No. 63/081,953, filed on Sep. 23, 2020.

(51) Int. Cl.

| | |
|---|---|
| ***F04D 29/66*** | (2006.01) |
| ***F04D 13/08*** | (2006.01) |
| ***F04D 1/06*** | (2006.01) |
| ***F04D 29/44*** | (2006.01) |
| ***F04D 29/046*** | (2006.01) |
| ***E21B 43/12*** | (2006.01) |

(52) U.S. Cl.

CPC ..... *F04D 29/669* (2013.01); *F04D 1/06* (2013.01); *F04D 13/086* (2013.01); *F04D 29/046* (2013.01); *F04D 29/445* (2013.01); *E21B 43/128* (2013.01)

(58) Field of Classification Search

CPC ..... F04D 13/086; F04D 13/10; F04D 29/445; F04D 29/669; F04D 1/06; E21B 43/128

See application file for complete search history.

(56) References Cited

U.S. PATENT DOCUMENTS

| | | | |
|---|---|---|---|
| 1,387,660 | A | 8/1921 | Pontus |
| 2,954,739 | A | 10/1960 | Lung |
| 3,116,696 | A | 1/1964 | Deters |
| 3,154,019 | A | 10/1964 | Hoyt |
| 3,265,001 | A | 8/1966 | Deters |
| 3,612,716 | A | 10/1971 | Deters |

(Continued)

FOREIGN PATENT DOCUMENTS

| | | |
|---|---|---|
| JP | 10089281 | 4/1998 |
| JP | 2005002943 A | 1/2005 |

OTHER PUBLICATIONS

International Search Report and Written Opinion issued in the PCT Application PCT/US2015/043073, dated Oct. 23, 2015 (11 pages).

(Continued)

*Primary Examiner* — Sabbir Hasan
*Assistant Examiner* — Jackson N Gillenwaters
(74) *Attorney, Agent, or Firm* — Matthew Goode

(57) ABSTRACT

Systems and features for improving sand control in pumps are provided. These features can be used in centrifugal pumps employed in a variety of oilfield applications, such as in electric submersible pumping systems positioned downhole in a wellbore to pump oil or other fluids. Such features include shielded anti-swirl ribs positioned in the balance chamber.

19 Claims, 7 Drawing Sheets

(56) References Cited

U.S. PATENT DOCUMENTS

| | | | | |
|---|---|---|---|---|
| 3,730,641 | A | 5/1973 | Gordon | |
| 7,841,826 | B1 | 11/2010 | Phillips | |
| 8,556,580 | B2 | 10/2013 | Stair et al. | |
| 9,039,356 | B1 | 5/2015 | Nowitzki et al. | |
| 9,200,642 | B2 | 12/2015 | Nowitzki et al. | |
| 10,233,937 | B1 | 3/2019 | Volk | |
| 10,738,794 | B2 | 8/2020 | Rao et al. | |
| 2005/0074330 | A1 | 4/2005 | Watson et al. | |
| 2009/0047119 | A1 | 2/2009 | Bookout et al. | |
| 2013/0209225 | A1* | 8/2013 | Eslinger | F04D 1/06 29/888.024 |
| 2017/0167498 | A1* | 6/2017 | Chang | F04D 29/0416 |
| 2017/0248159 | A1* | 8/2017 | Rao | F04D 29/669 |
| 2017/0350399 | A1* | 12/2017 | Eslinger | F04D 29/426 |
| 2018/0291907 | A1* | 10/2018 | Ye | F04D 29/026 |
| 2020/0116152 | A1* | 4/2020 | Smith | F04D 1/06 |

OTHER PUBLICATIONS

International Preliminary Report on Patentability issued in the PCT Application PCT/US2015/043073, dated Feb. 23, 2017 (10 pages).

* cited by examiner

ANTI-SWIRL RIBS IN ELECTRIC SUBMERSIBLE PUMP BALANCE RING CAVITY

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 63/081,953, filed Sep. 23, 2020, the entirety of which is incorporated by reference herein and should be considered part of this specification.

BACKGROUND

Field

The present disclosure generally relates to electric submersible pumps (ESPs), and more particularly to anti-swirl features for ESPs.

Description of the Related Art

Various types of artificial lift equipment and methods are available, for example, electric submersible pumps (ESPs). An ESP includes multiple centrifugal pump stages mounted in series, each stage including a rotating impeller and a stationary diffuser mounted on a shaft, which is coupled to a motor. In use, the motor rotates the shaft, which in turn rotates the impellers within the diffusers. Well fluid flows into the lowest stage and passes through the first impeller, which centrifuges the fluid radially outward such that the fluid gains energy in the form of velocity. Upon exiting the impeller, the fluid flows into the associated diffuser, where fluid velocity is converted to pressure. As the fluid moves through the pump stages, the fluid incrementally gains pressure until the fluid has sufficient energy to travel to the well surface.

SUMMARY

In general, a system and methodology are provided for improving sand control in pumps.

In some configurations, a system for controlling erosion in a pumping assembly includes a pump comprising an impeller, a diffuser, a balance chamber disposed axially between a portion of the impeller and a portion of the diffuser, and a plurality of shielded ribs disposed in the balance chamber, the shielded ribs configured to reduce a velocity of swirling fluid flow in the balance chamber to reduce erosion.

The diffuser can include a central hub, a balance ring step radially spaced from and circumferentially surrounding the central hub, and a lower plate extending between and connecting the central hub and the balance ring step. The shielded ribs can be at least partially defined by cavities formed in the balance ring step adjacent the lower plate. The shielded ribs and/or cavities can be rectangular. The diffuser can further include one or more anti-swirl ribs protruding radially outward from the central hub adjacent the lower plate.

In some configurations, a system includes an electric submersible pump and a motor configured to power the electric submersible pump. The electric submersible pump includes a plurality of stages, each stage comprising an impeller and a diffuser, the impeller configured to direct fluid flow into the diffuser in use, the impeller comprising an upwardly extending balance ring, the diffuser comprising a hub and a balance ring step radially spaced from and circumferentially surrounding the hub, a radially outer surface of the balance ring positioned adjacent a radially inner surface of the balance ring step, and a balance cavity at least partially defined by the balance ring, the balance ring step, and the hub, the diffuser comprising a shielded rib feature formed in the balance ring step and configured to reduce velocity of swirling fluid flow in the balance cavity.

The shielded rib feature can be at least partially defined by cavities formed in the radially inner surface of the balance ring step. The cavities can be disposed adjacent a lower plate extending between and connecting the hub and the balance ring step of the diffuser. The diffuser can further include one or more anti-swirl ribs protruding radially outward from the hub. The hub of the diffuser can include or act as a bearing housing. A bearing assembly can be disposed radially between the bearing housing and a shaft extending axially through the plurality of stages. The system can further include a protector.

In some configurations, an electric submersible pump includes a shaft; at least one impeller disposed about and configured to rotate with the shaft, and at least one rotationally stationary diffuser disposed about the shaft. The impeller includes a central hub defining a bore through which the shaft extends; a skirt positioned radially outward from and disposed circumferentially about the central hub, a space radially between the central hub and the skirt defining an intake of the impeller; an upper shroud extending at an angle radially outward and downstream from the central hub; a lower shroud extending at an angle radially outward and downstream from the skirt; and a balance ring extending upward or downstream from the upper shroud. The diffuser is positioned adjacent and downstream of the at least one impeller along the shaft and includes a hub or bearing housing defining a bore through which the shaft extends; a balance ring step radially spaced from and circumferentially surrounding the hub or bearing housing; and a lower plate extending between and connecting the balance ring step and the hub or bearing housing. The pump includes a balance ring cavity defined by a lower surface of the lower plate, an upper surface of the upper shroud, a radially outer surface of the hub or bearing housing, a radially inner surface of the balance ring, and a radially inner surface of the balance ring step. The pump also includes a plurality of shielded anti-swirl ribs configured to slow swirling fluid flow in the balance ring cavity.

The shielded anti-swirl ribs can be defined by cavities formed in the radially inner surface of the balance ring step adjacent the lower surface of the lower plate. The cavities and/or shielded anti-swirl ribs can be rectangular. The pump can further include one or more anti-swirl ribs protruding radially outward from the hub or bearing housing adjacent the lower surface of the lower plate. The pump can further include a bearing assembly disposed radially between the bearing housing and the shaft. The diffuser can further include an outer housing radially spaced from and circumferentially surrounding the balance ring step. Diffuser vanes can extend between the outer housing and one or both of the balance ring step and the lower plate.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
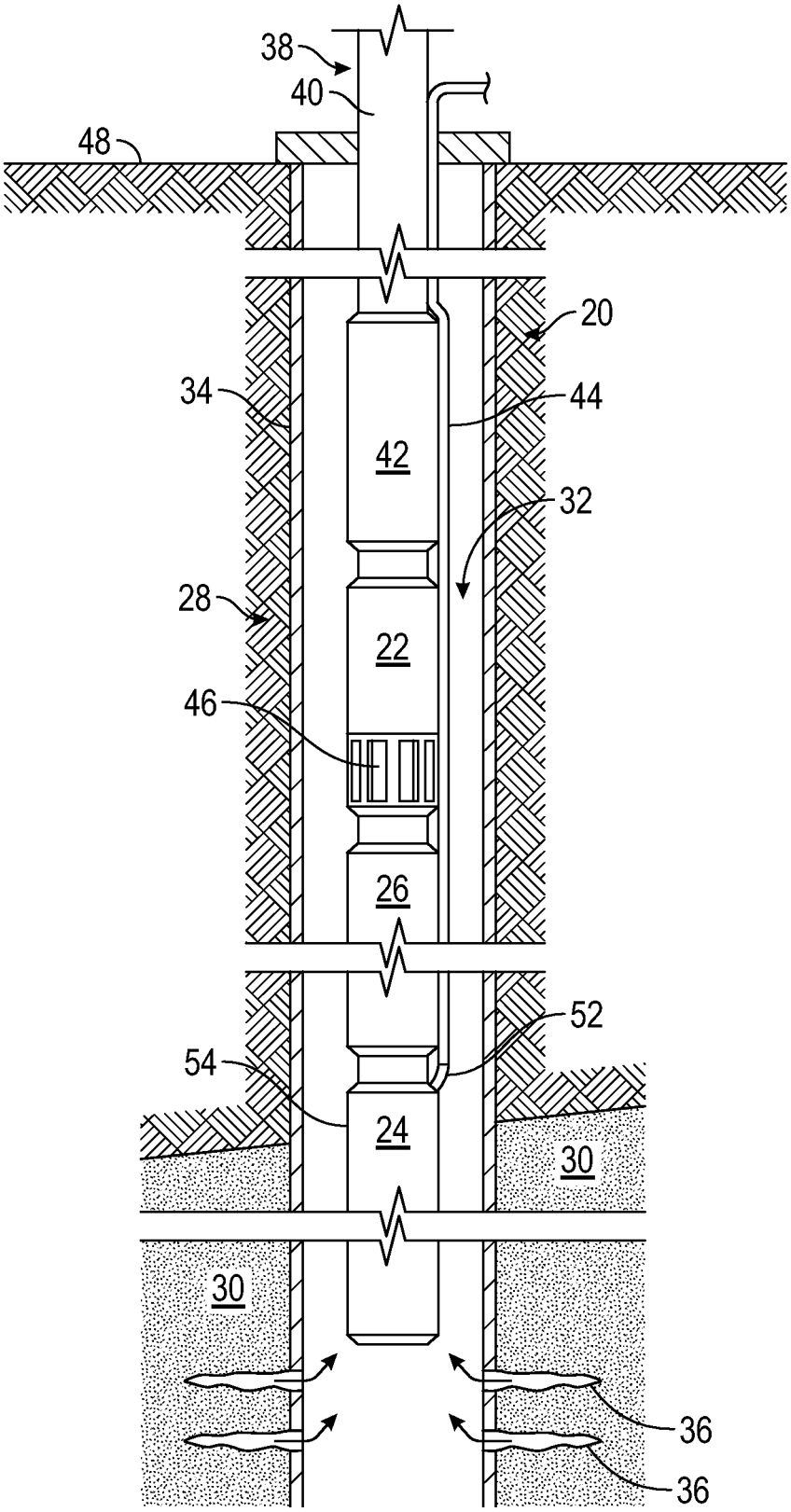
FIG. 1 shows a schematic of an electric submersible pump (ESP) system.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Various types of artificial lift equipment and methods are available, for example, electric submersible pumps (ESP). Electric Submersible Pump (ESP) systems are used in a variety of well applications. ESP systems may comprise centrifugal pumps having a plurality of stages with each stage employing a diffuser and an impeller. In oil wells producing substantial amounts of sand, the lifetime of the centrifugal pump may be shortened due to excessive wear. The sand tends to wear on the pumping system components and increases clearances in the case of radial wear. This type of wear can lead to a decrease in the head flow and an increased horsepower demand, thus affecting pump performance. The abrasive sand also can cause holes to develop in diffuser walls and can lead to erosion of pump passages.

Erosive wear often occurs at points where flow discontinuities exist and also in void areas of the diffuser and impeller where sand can get entrapped and circulated. For example during operation of the ESP system, sand can get trapped in the balance ring cavity and continue recirculating and swirling, eventually causing erosion. Anti-swirl ribs on an exterior of the diffuser bore can help slow down, but cannot stop, the swirling fluids. Over time, erosion on the diffuser balance ring step can cut into the diffuser flow passage. Additional details regarding anti-swirl ribs can be found in U.S. Pat. No. 10,738,794, the entirety of which is hereby incorporated herein by reference.

The present disclosure generally relates to a system and methodology for improving sand control in pumps. The technique may be used in centrifugal pumps by employing a uniquely constructed rib feature to facilitate sand control and thus to reduce erosion from sand in the pumped fluid. In some configurations, one or more shielded ribs are located in the balance ring cavity. The shielded ribs can slow, and potentially stop, swirling flow within the balance chamber. The shielded ribs can be hidden below the diffuser balance ring surface. The ribs and/or cavities at least partially created by the ribs can have various sizes and/or shapes. The shielded ribs can be equally spaced. In some configurations, the present disclosure relates to anti-swirling ribs on an outer diameter of the diffuser bore, which can be used instead of or in addition to the shielded ribs to further slow swirling fluid. Rib feature(s) according to the present disclosure may be deployed in a variety of centrifugal pumps, such as the centrifugal pumps employed in electric submersible pumping systems operated downhole in sandy environmental conditions.

Referring generally to FIG. 1, an embodiment of a submersible pumping system 20, such as an electric submersible pumping system, is illustrated. Submersible pumping system 20 may comprise a variety of components depending on the particular application or environment in which it is used. Examples of components utilized in pumping system 20 comprise at least one submersible pump 22, at least one submersible motor 24, and at least one protector 26 coupled together to form the submersible pumping system 20.

In the example illustrated, submersible pumping system 20 is designed for deployment in a well 28 within a geological formation 30 containing desirable production fluids, such as petroleum. A wellbore 32 is drilled into formation 30, and, in at least some applications, is lined with a wellbore casing 34. Perforations 36 are formed through wellbore casing 34 to enable flow of fluids between the surrounding formation 30 and the wellbore 32.

Submersible pumping system 20 is deployed in wellbore 32 by a conveyance system 38 that may have a variety of configurations. For example, conveyance system 38 may comprise tubing 40, such as coiled tubing or production tubing, connected to submersible pump 22 by a connector 42. Power is provided to the at least one submersible motor 24 via a power cable 44. The submersible motor 24, in turn, powers submersible pump 22 which can be used to draw in production fluid through a pump intake 46. In a variety of applications, the submersible pump 22 may comprise a centrifugal pump. Within the submersible centrifugal pump 22, a plurality of impellers is rotated between diffusers to pump or produce the production fluid through, for example, tubing 40 to a desired collection location which may be at a surface 48 of the Earth. As described above, however, components of the pump often suffer deleterious, erosive effects without inclusion of the unique erosion control features described in greater detail below.

It should be noted that many types of electric submersible pumping systems and other types of submersible pumping systems can benefit from the features described herein. Additionally, other components may be added to the pumping system 20, and other deployment systems may be used. Depending on the application, the production fluids may be pumped to the collection location through tubing 40 or through the annulus around deployment system 38. The submersible pump or pumps 22 also may utilize different types of stages, such as mixed flow stages or radial flow stages, having various styles of impellers and diffusers.

Figure 2:
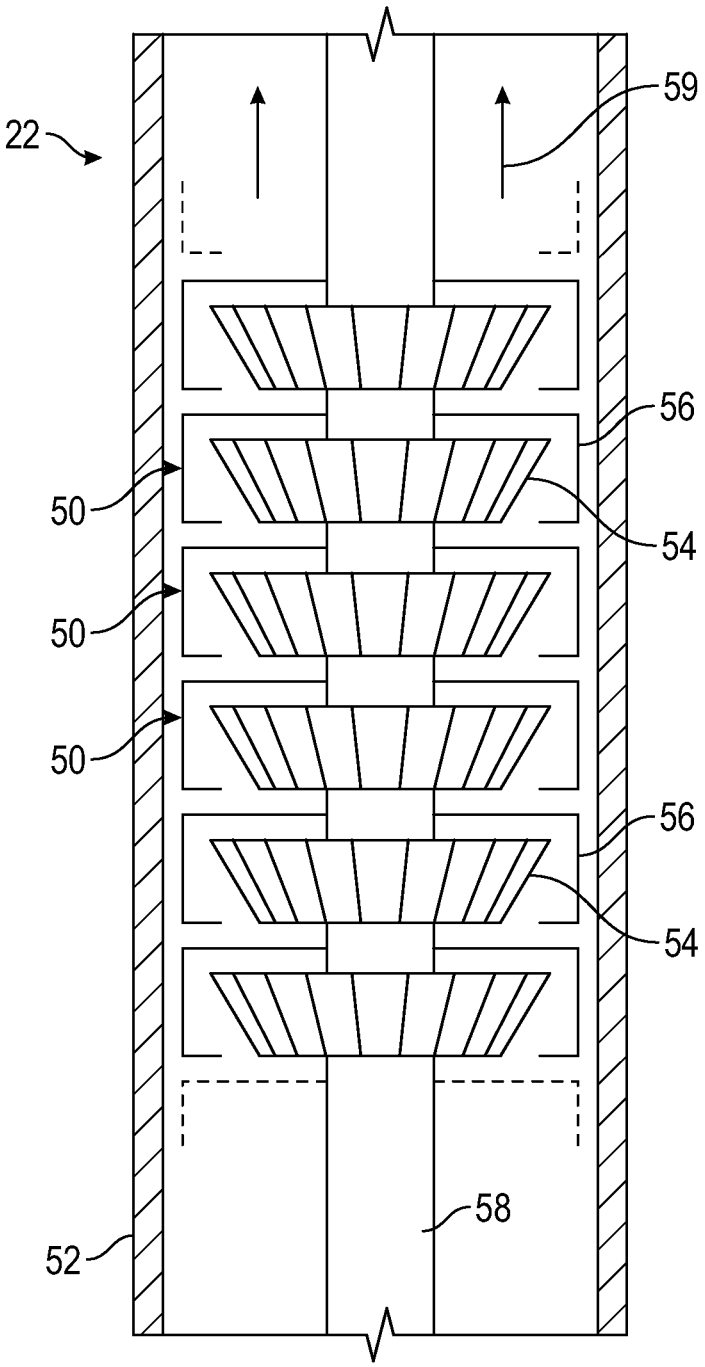
FIG. 2 shows a schematic of a plurality of ESP stages.
Figure 3:
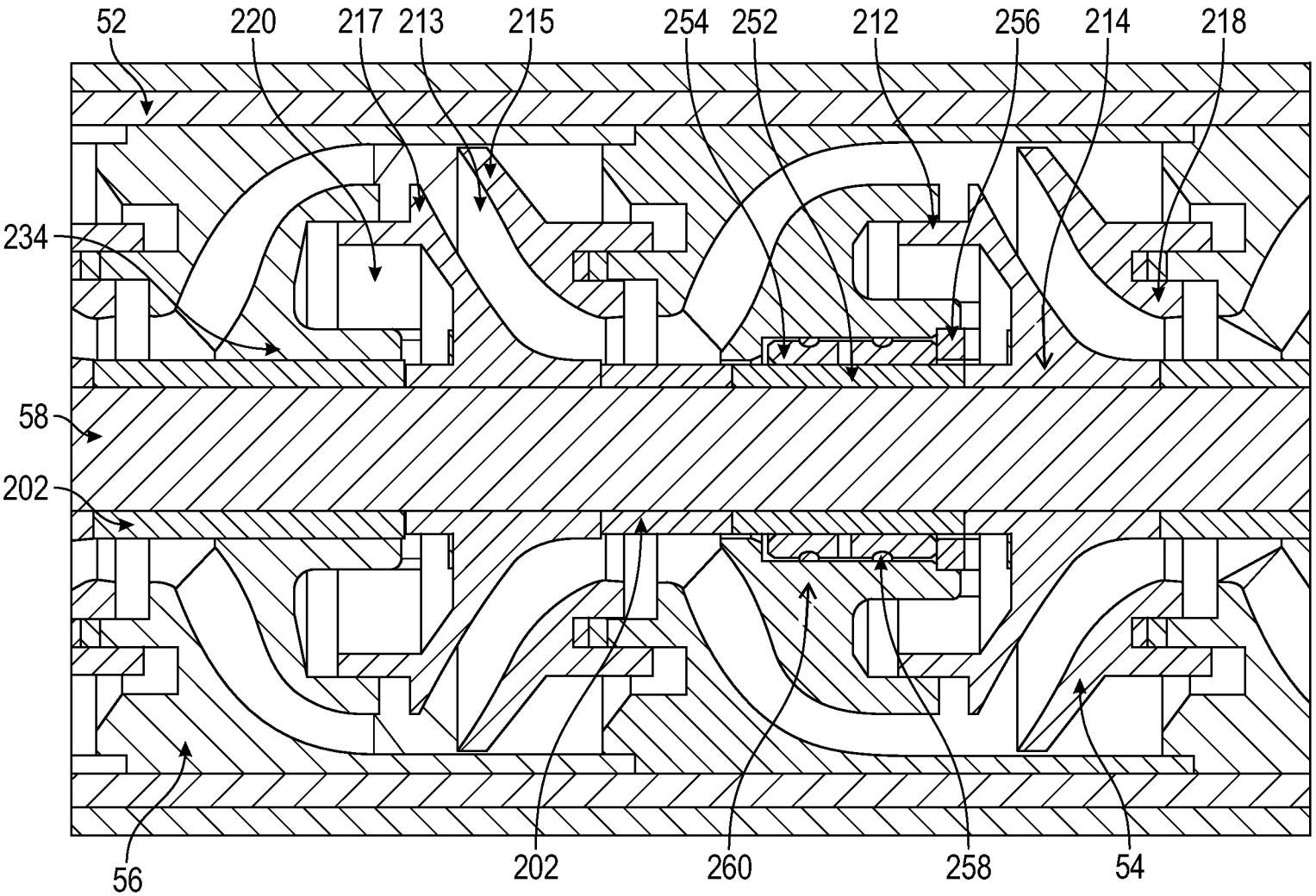
FIG. 3 shows a longitudinal cross-section of a portion of an ESP.

Referring generally to FIG. 2, a portion of an embodiment of submersible pump 22 is illustrated. In this embodiment, the submersible pump 22 is a centrifugal pump comprising at least one stage and often a plurality of stages 50 disposed within an outer pump housing 52. Each stage 50 comprises pump components for inducing and directing fluid flow. As illustrated, the pump components in each stage comprise an impeller 54 and a diffuser 56. Impellers 54 are rotated by a shaft 58 coupled with an appropriate power source, such as submersible motor 24, to pump fluid through centrifugal pump 22 in the direction of arrow 59. As shown in FIG. 3, one or more spacers 202 can be disposed axially between sequential impellers 54.

Each rotating impeller 54 moves fluid from the upstream diffuser 56 into and through the downstream diffuser 56 and into the next sequential impeller 54 until the fluid is expelled from centrifugal pump 22. By way of example, each rotating impeller 54 may discharge fluid to the adjacent downstream diffuser 56 which routes the fluid into a diffuser bowl for receipt by the next sequential impeller 54. The fluid flow is routed through the sequential stages 50 of the submersible centrifugal pump 22 until the fluid is expelled from the submersible pump 22.

Figure 4:
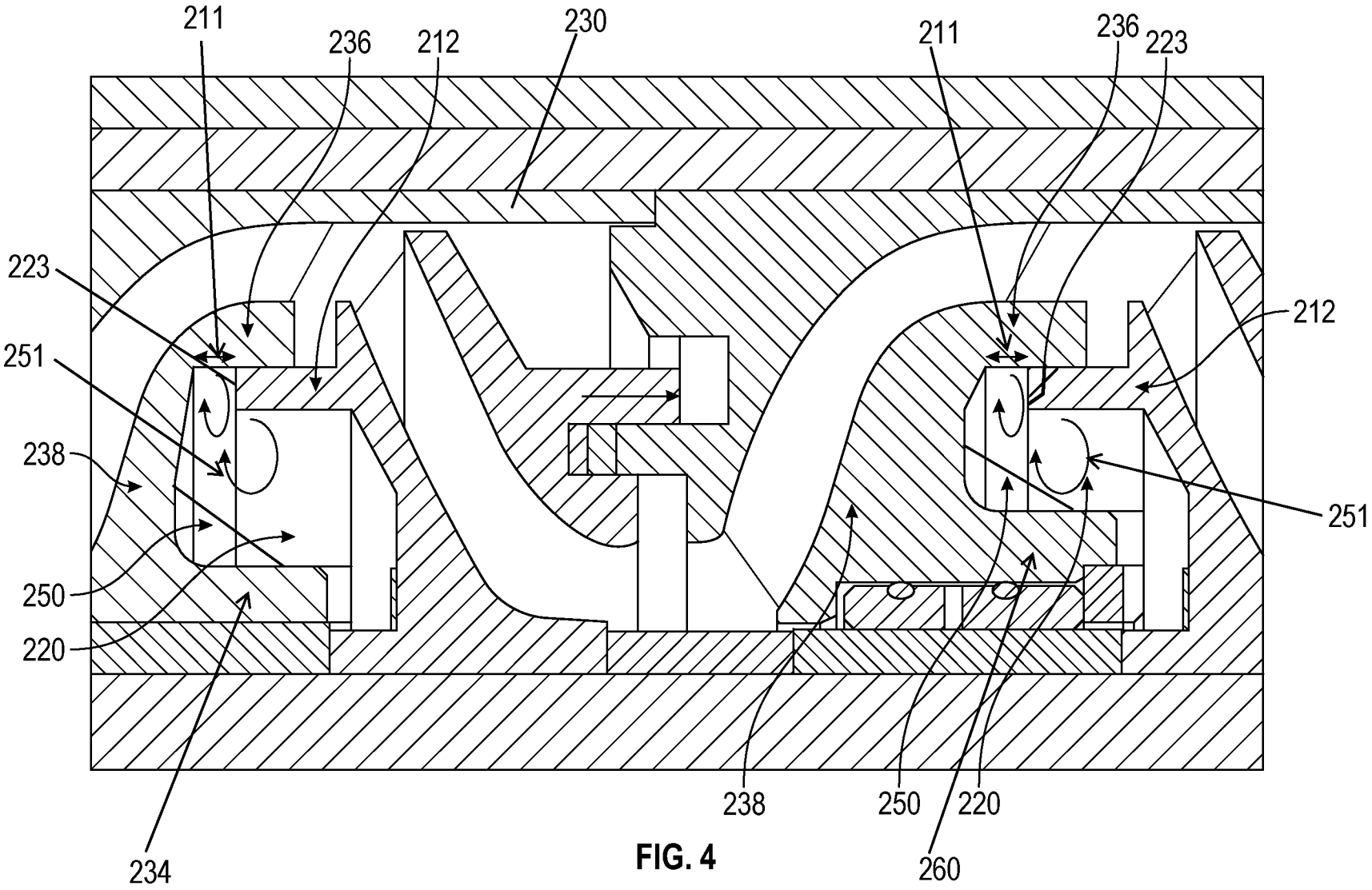
FIG. 4 shows an enlarged portion of FIG. 3.

FIG. 3 shows a partial longitudinal cross-section of an ESP layout including a bearing sub-assembly, and FIG. 4 shows an enlarged portion of FIG. 3. As shown, a bearing assembly can be disposed between, e.g., at least partially radially between, the shaft 58 and a diffuser 56 and/or between, e.g., at least partially axially between, an impeller 54 and its associated diffuser 56. A portion of the diffuser 56 can act as a bearing housing 260. In the illustrated embodiment, the bearing assembly includes a bearing sleeve 252 disposed about the shaft 58 and a bushing 254 disposed about the bearing sleeve 252 and radially between the bearing sleeve 252 and a portion of the diffuser 56 (e.g., the bearing housing 260). One or more o-rings 258 can be disposed about the bushing 254, for example, radially between the bushing 254 and the diffuser 56 or bearing housing 260.

The illustrated bearing assembly also includes an anti-rotation upthrust ring 256 disposed about the bearing sleeve 252. As shown, the anti-rotation upthrust ring 256 can be disposed adjacent an upstream end of the bushing 254. The bearing sleeve 252 is keyed or rotationally coupled to the shaft 58 such that the bearing sleeve 252 rotates with the shaft 58 in use. The anti-rotation upthrust ring 256 prevents or inhibits the bushing 254 from rotating such that the bushing 254 is stationary or rotationally fixed relative to the diffuser 56. The anti-rotation upthrust ring 256 can also help prevent or inhibit axial movement of the bushing 254 and/or the bushing 254 from dropping out of place from the bearing housing 260. In use, the bearing assembly can help absorb thrust and/or accommodate the rotation of the shaft relative to the diffuser.

The impeller 54 includes a central hub 214, surrounding a bore through which the shaft 58 extends, and a skirt 218 radially or circumferentially surrounding a portion of the hub 214. A space between (e.g., radially between) the skirt 218 and hub 214 defines an intake or inlet of the impeller 54 and a portion of a flow path through the impeller 54. Impeller blades or vanes 213 extend radially outward from the hub 214. In the illustrated configuration, the impeller 54 includes an upper plate, disc, or shroud 217 and a lower plate, disc, or shroud 215. The upper shroud 217 extends radially outward from the hub 214. In the illustrated configuration, the upper shroud 217 extends at an angle radially outward and upward or downstream from the hub 214. The lower shroud 215 extends radially outward from the skirt 218. In the illustrated configuration, the lower shroud 215 extends at an angle radially outward and upward or downstream from the skirt 218. The impeller blades 213 can extend between (e.g., axially between) the lower 215 and the upper shroud 217. The illustrated impeller 54 can therefore be considered a shrouded impeller. The hub 214, blades 213, lower shroud 215, and upper shroud 217 define fluid flow paths through the impeller 54. As shown, the impeller 54 also includes a balance ring 212 extending upwardly or downstream, e.g., extending longitudinally upwardly or downstream along an axis parallel to a longitudinal axis of the shaft 58, from a top or downstream surface of the upper shroud 217.

In some diffusers 56, the bearing housing 260 can form or define a bore through which the shaft 58 extends. Other diffusers 56 include a central hub 234 that surrounds the bore through which the shaft 58 extends, as also shown in FIG. 3. As shown in FIG. 4, the diffuser 56 also includes a balance ring step 236 radially spaced from and radially or circumferentially surrounding the bearing housing 260 or central hub 234. A lower plate 238 extends between (radially between) and connects the balance ring step 236 and the bearing housing 260 or central hub 234. An outer housing 230 of the diffuser 56 is radially spaced from and radially or circumferentially surrounds the balance ring step 236. Diffuser blades or vanes 233 extend between the outer housing 230 and the balance ring step 236 and/or lower plate 238.

A radially outer surface of the balance ring 212 of a given impeller 54 can contact or be disposed adjacent or facing a radially inner surface of the balance ring step 236 of the next sequential downstream diffuser 56. The balance ring 212 partially defines a balance ring cavity 220 formed radially between the balance ring 212 and the shaft 58, the bearing housing 260, or the central hub 234 of the diffuser 56. A tip clearance or balance ring clearance 211 is formed or defined axially between an uppermost or downstream-most edge or tip 223 of the balance ring 212 and a lower or generally upstream facing surface of the diffuser lower plate 238, as shown in FIG. 4.

Figure 5:
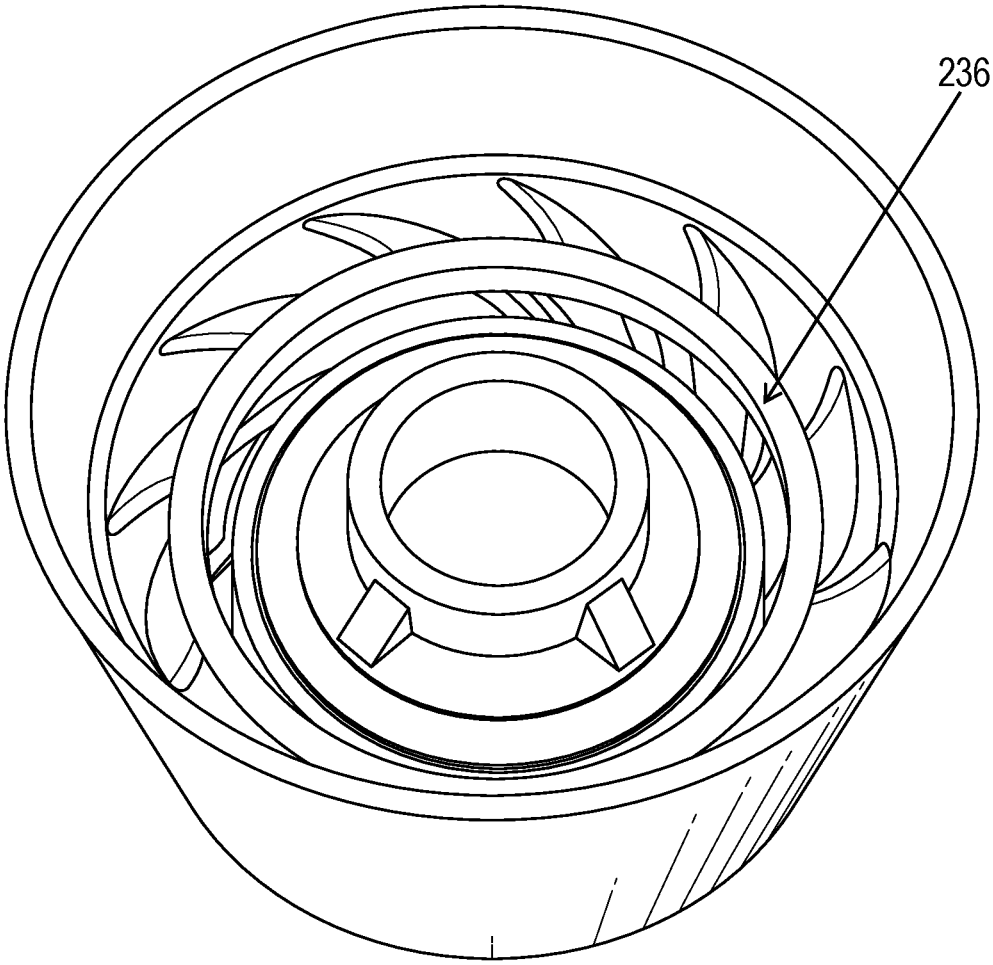
FIG. 5 shows a diffuser damaged by erosion.

During pump operation, well fluids can pass through the balance ring clearance, allowing sand ingress into the balance ring cavity 220. Trapped sands continue to recirculate and swirl, as indicated by swirling flow 251, which can cause erosion and damage. Over time, erosion can damage the diffuser balance ring step 236, as shown in FIG. 5, allowing sand to leak into the diffuser 56 or bearing housing 260 flow passage. The swirling velocity of the sand particles increases with increasing rotational speed of the impeller 54 as the radially inner surface of the balance ring 212 and balance ring tip 223 drag fluids in the balance ring cavity 220 in rotational motion. In a high speed ESP operation, for example, >3500 rpm, erosion wear in the balance ring cavity 220 is therefore accelerated. When the impeller 54 moves downward in use due to axial deflection, the balance ring tip clearance increases, thereby increasing swirling flow in the balance ring tip clearance area and accelerating erosion wear.

Figure 8:
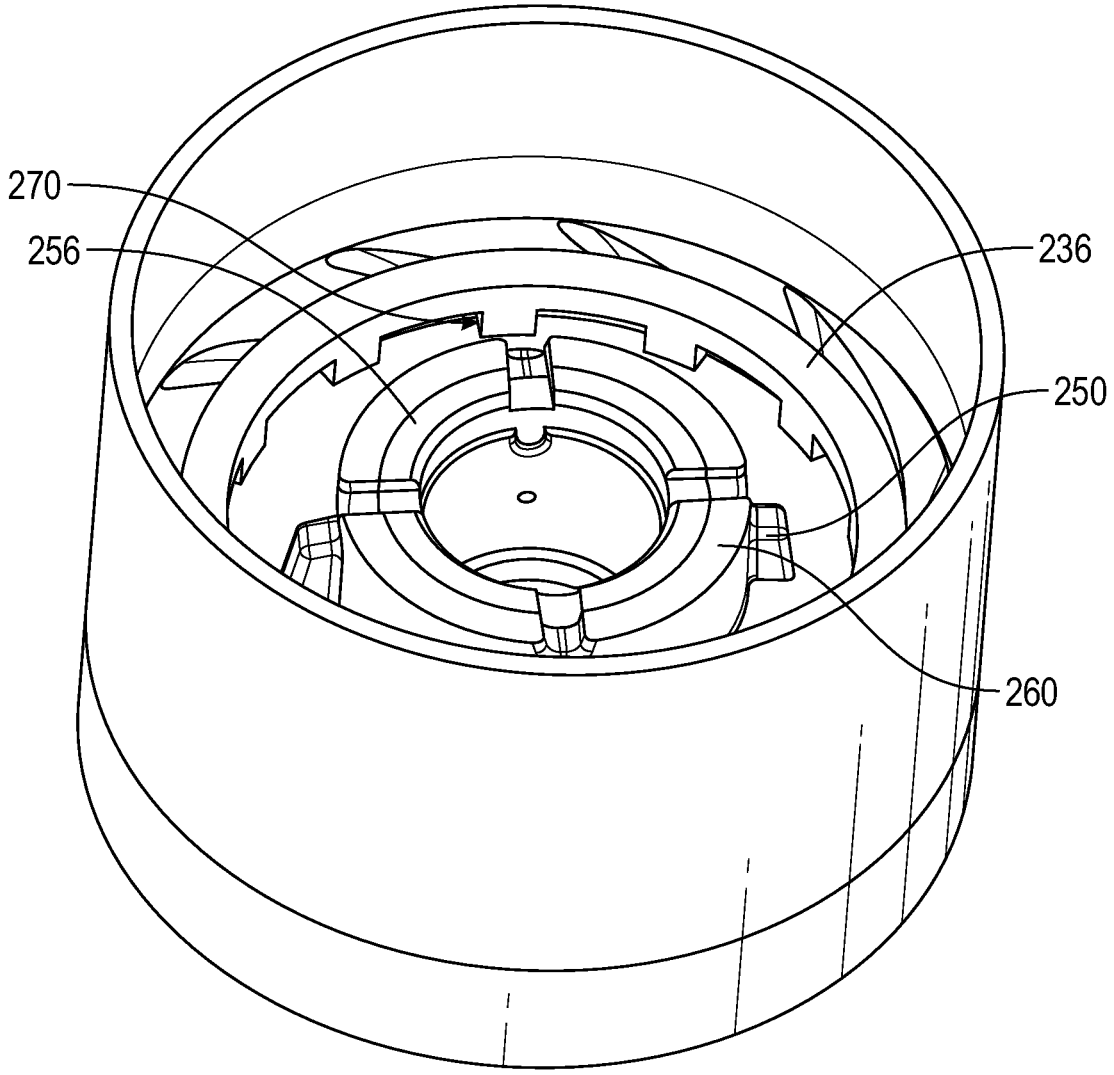
FIG. 8 shows a perspective view of the diffuser of FIG. 6.

In some configurations, for example as shown in FIGS. 4 and 8, one or more anti-swirl ribs 250 are disposed on an exterior of the diffuser bore, for example, projecting radially outward from the bearing housing 260 or the central hub 234. The anti-swirl ribs 250 can extend along the lower or generally upstream facing surface of the diffuser lower plate 238. The anti-swirl ribs 250 can help slow the swirling fluids 251 in the balance cavity 220. In the illustrated configuration, the anti-swirl ribs 250 have a triangular or generally triangular longitudinal cross-sectional shape as shown. In other words, the anti-swirl ribs 250 extend radially outward to a greater extent at their upper or downstream ends, adjacent or proximate the diffuser lower plate 238, than at their lower or upstream ends. The anti-swirl ribs 250 can have various other shapes, sizes, widths, and heights. The illustrated configuration includes four anti-swirl ribs 250 spaced at 90° intervals about the circumference of the bearing housing 260 or central hub 234. However, other numbers and/or spacings are also possible.

Figure 6:
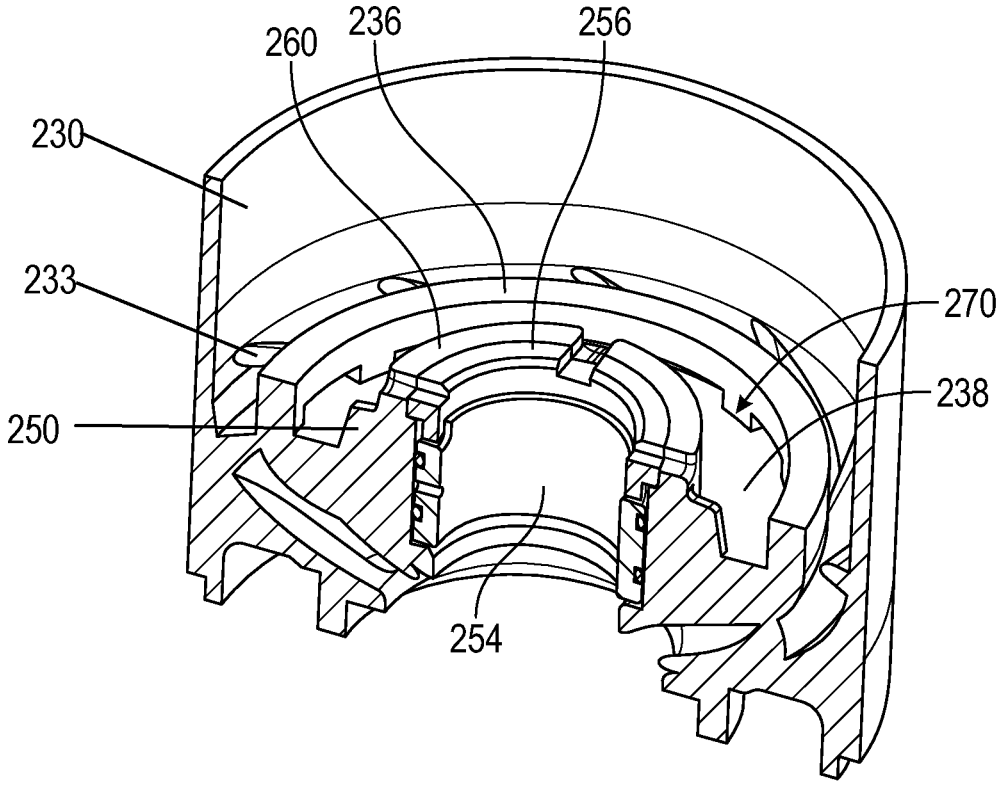
FIG. 6 shows a perspective longitudinal cross-section of a diffuser including anti-swirl features.
Figure 7:
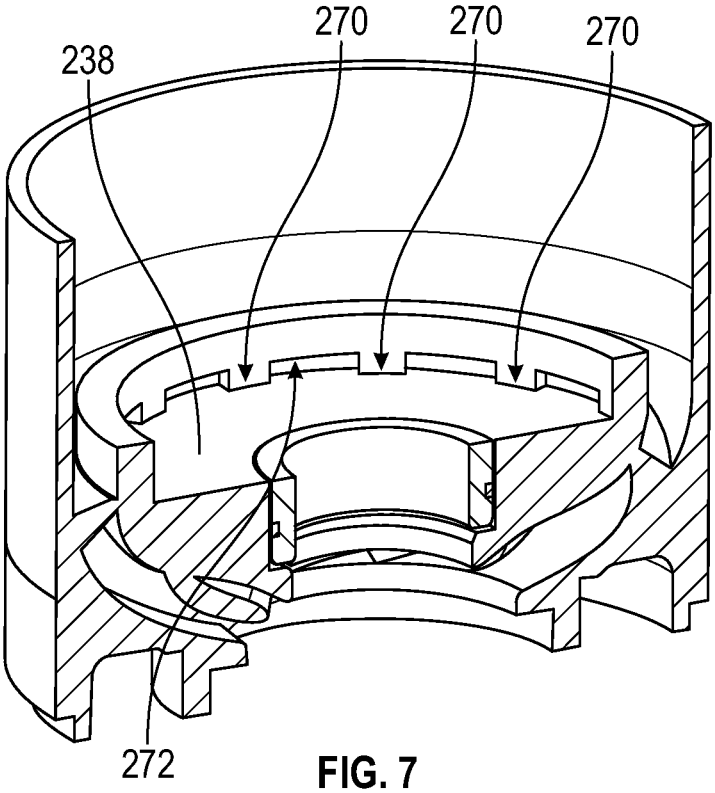
FIG. 7 shows the diffuser of FIG. 6 with certain features removed for clarity.

In some configurations, shielded anti-swirl ribs 270 can be disposed in the balance ring cavity 220, for example as shown in FIGS. 6-8. These shielded anti-swirl ribs 270 can slow down, and potentially stop, swirling flow in the balance chamber 220. The anti-swirl ribs 270 can be hidden below the diffuser balance ring step 236. The anti-swirl ribs 270 can formed or defined by cavities or recesses 272 formed in the radially inner surface of the balance ring step 236 adjacent or proximate the diffuser lower plate 238. The remainder of the balance ring step 236 therefore shields the ribs 270 and cavities 272. The shielded anti-swirl ribs 270 and/or cavities 272 can have various sizes and/or shapes. The shielded anti-swirl ribs 270 and/or cavities 272 can be equally or unequally spaced circumferentially about the balance ring step 236.

In use, as fluid, which may include sand, swirls around the cavities 272, the ribs 270 obstruct and decelerate the swirling flow. This can mitigate, inhibit, or prevent erosion wear and improve the reliability of the diffuser 56 and bearing housing 260. The shielded anti-swirl ribs 270 and anti-swirl ribs 250 can be used in combination or separately.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A system for controlling erosion in a pumping assembly, comprising:

a pump comprising an impeller, a diffuser, a balance chamber disposed axially between a portion of the impeller and a portion of the diffuser, and a plurality of shielded ribs disposed in the balance chamber, the shielded ribs configured to reduce a velocity of swirling fluid flow in the balance chamber to reduce erosion;

the diffuser comprising a central hub, a balance ring step radially spaced from and circumferentially surrounding the central hub, and a lower plate extending between and connecting the central hub and the balance ring step, wherein the shielded ribs are at least partially defined by cavities formed in the balance ring step adjacent the lower plate.

2. The system of claim 1, wherein the shielded ribs are rectangular.

3. The system of claim 1, wherein the cavities are rectangular.

4. The system of claim 1, further comprising one or more anti-swirl ribs protruding radially outward from the hub adjacent a lower plate.

5. A system comprising:

an electric submersible pump comprising a plurality of stages, each stage comprising an impeller and a diffuser, the impeller configured to direct fluid flow into the diffuser in use, the impeller comprising an upwardly extending balance ring, the diffuser comprising a hub and a balance ring step radially spaced from and circumferentially surrounding the hub, a radially outer surface of the balance ring positioned adjacent a radially inner surface of the balance ring step, and a balance cavity at least partially defined by the balance ring, the balance ring step, and the hub, the diffuser comprising a shielded rib feature formed in the balance ring step and configured to reduce velocity of swirling fluid flow in the balance cavity; and a motor configured to power the electric submersible pump.

6. The system of claim 5, wherein the shielded rib feature is at least partially defined by cavities formed in the radially inner surface of the balance ring step.

7. The system of claim 6, wherein the cavities are disposed adjacent a lower plate extending between and connecting the hub and the balance ring step of the diffuser.

8. The system of claim 5, further comprising one or more anti-swirl ribs protruding radially outward from the hub.

9. The system of claim 5, further comprising a protector.

10. The system of claim 5, wherein the hub of the diffuser comprises a bearing housing.

11. The system of claim 10, further comprising a bearing assembly disposed radially between the bearing housing and a shaft extending axially through the plurality of stages.

12. An electric submersible pump comprising:

a shaft;

at least one impeller disposed about and configured to rotate with the shaft, the impeller comprising:

a central hub defining a bore through which the shaft extends;

a skirt positioned radially outward from and disposed circumferentially about the central hub, a space radially between the central hub and the skirt defining an intake of the impeller;

an upper shroud extending at an angle radially outward and downstream from the central hub;

a lower shroud extending at an angle radially outward and downstream from the skirt; and a balance ring extending upward or downstream from the upper shroud;

at least one rotationally stationary diffuser disposed about the shaft, the at least one diffuser positioned adjacent and downstream of the at least one impeller along the shaft, the diffuser comprising:

a hub or bearing housing defining a bore through which the shaft extends;

a balance ring step radially spaced from and circumferentially surrounding the hub or bearing housing; and a lower plate extending between and connecting the balance ring step and the hub or bearing housing;

a balance ring cavity defined by a lower surface of the lower plate, an upper surface of the upper shroud, a radially outer surface of the hub or bearing housing, a radially inner surface of the balance ring, and a radially inner surface of the balance ring step; and a plurality of shielded anti-swirl ribs configured to slow swirling fluid flow in the balance ring cavity.

13. The electric submersible pump of claim 12, wherein the shielded anti-swirl ribs are defined by cavities formed in the radially inner surface of the balance ring step adjacent the lower surface of the lower plate.

14. The electric submersible pump of claim 13, wherein the cavities are rectangular.

15. The electric submersible pump of claim 12, wherein the shielded anti-swirl ribs are rectangular.

16. The electric submersible pump of claim 12, further comprising one or more anti-swirl ribs protruding radially outward from the hub or bearing housing adjacent the lower surface of the lower plate.

17. The electric submersible pump of claim 12, further comprising a bearing assembly disposed radially between the bearing housing and the shaft.

18. The electric submersible pump of claim 12, the diffuser further comprising an outer housing radially spaced from and circumferentially surrounding the balance ring step.

19. The electric submersible pump of claim 18, the diffuser further comprising diffuser vanes extending between the outer housing and one or both of the balance ring step and the lower plate.

* * * * *